US006434787B2

(12) United States Patent
Muller Carranza

(10) Patent No.: US 6,434,787 B2
(45) Date of Patent: Aug. 20, 2002

(54) DRAUGHT EXCLUDER FOR FASTENING DOORMATS

(76) Inventor: Luis Muller Carranza, Carretera Nacional II, Km. 774, 5, 17700 La Jonquera (Girona) (ES)

( * ) Notice: Subject to any disclaimer, the term of this patent is extended or adjusted under 35 U.S.C. 154(b) by 0 days.

(21) Appl. No.: 09/726,587

(22) Filed: Dec. 1, 2000

(30) Foreign Application Priority Data

Dec. 2, 1999 (ES) ..... 9903171

(51) Int. Cl.[7] ..... A47G 27/04

(52) U.S. Cl. ..... 16/4; 16/8; 16/16; 49/470; 49/475.1

(58) Field of Search ..... 16/4, 1, 8, 10, 16/16, 17.1; 52/273, 288.1, 302.1; 49/470, 477.1, 479.1, 475.1, 499.1

(56) References Cited

U.S. PATENT DOCUMENTS

| | | | | | |
|---|---|---|---|---|---|
| 2,770,002 | A | * | 11/1956 | Thompson | 16/7 |
| 2,980,943 | A | * | 4/1961 | Barnes et al. | 16/7 |
| 3,208,095 | A | * | 9/1965 | Hill | 16/16 |
| 3,710,414 | A | * | 1/1973 | Fuller et al. | 16/8 |
| 4,478,017 | A | * | 10/1984 | Brown et al. | 16/7 |
| 4,691,478 | A | * | 9/1987 | Lorg | 428/100 |

* cited by examiner

*Primary Examiner*—Chuck Y. Mah
(74) *Attorney, Agent, or Firm*—Dennison, Schultz & Dougherty

(57) ABSTRACT

Improved draught excluder for fastening doormats, of the type formed by an elongated prismatic body, consisting in that the prismatic head is formed by a sheet, in that it has, along its side, a "T", and in that its transverse arms are free, one of them being bent at right-angles.

5 Claims, 2 Drawing Sheets

DRAUGHT EXCLUDER FOR FASTENING DOORMATS

FIELD OF THE INVENTION

The subject of the present utility model relates to an improved draught excluder for fastening doormats.

BACKGROUND OF THE INVENTION

Doormat-fastening draught excluders are known which comprise a tubular sectional member provided with a base having a flat extension on which are arranged upright steel spikes which are to pierce the doormat.

The flat base is secured to the floor by known fastening systems.

A doormat-fastening draught excluder like that described can be found in Utility Model No. 226.331, which belongs to the same applicant.

The problem which those draught excluders present is that the doormat does not remain fixed securely in position and may cause people to trip accidentally.

On the other hand, the draught excluder has to be secured to the floor by means such as screws or nails, which means that it is awkward to fit.

SUMMARY OF THE INVENTION

The subject matter of the present utility model has been devised in order to avoid those disadvantages. Thanks to this subject matter, a doormat-fastening draught excluder is obtained which is easy to fit and also to remove, for the purpose of cleaning the doormat, and additionally in which the doormat is fully secured to the draught excluder, thus preventing displacement of the mat by accidental pushing and therefore reducing the possibility of tripping.

BRIEF DESCRIPTION OF THE INVENTION

For a better understanding of the subject matter of the invention, a practical embodiment of the invention is described hereinafter by way of non-limiting example, the description being accompanied by two sheets of drawings in which.

DETAILED DESCRIPTION OF THE INVENTION

Figure 1:
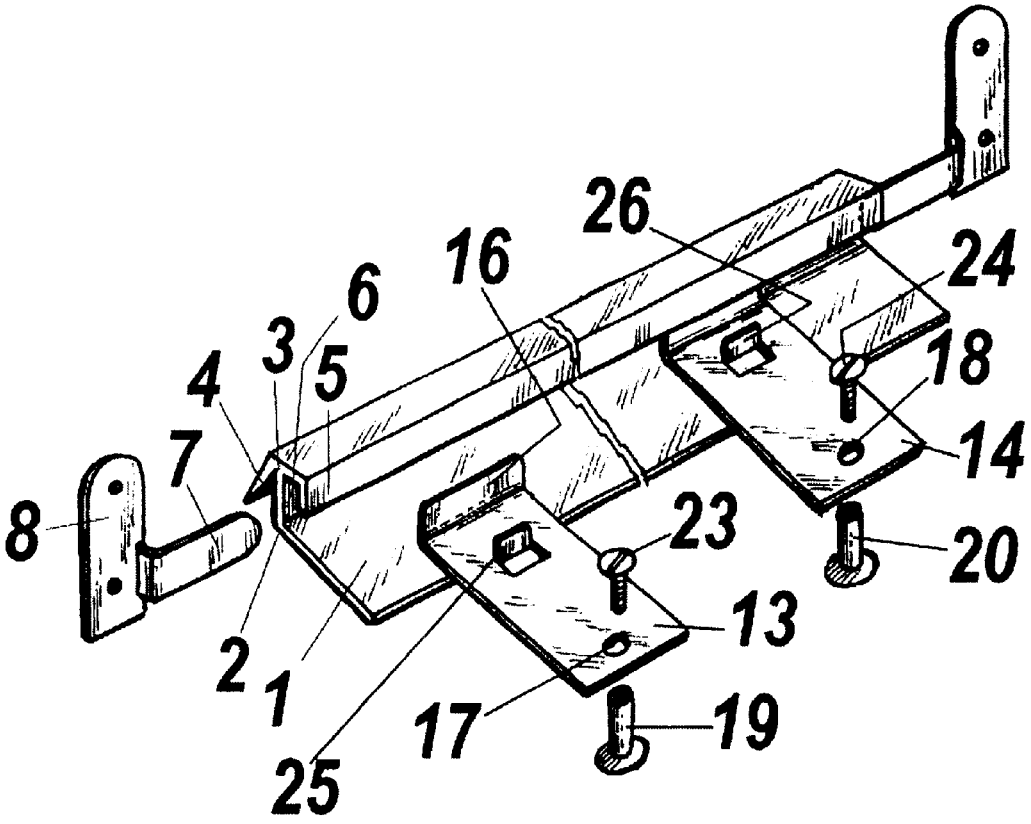
FIG. 1 is an exploded perspective view of the shortened draught excluder forming the subject matter of the invention, without the doormat.
Figure 2:
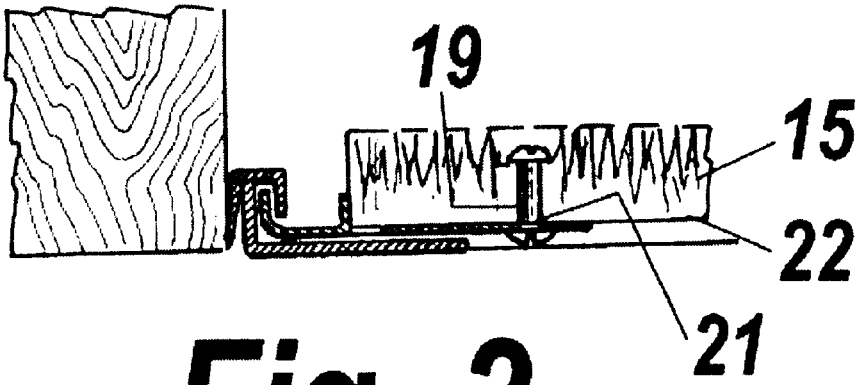
FIG. 2 is a cross-section through the draught excluder, once it has been connected to the door and the doormat has been fastened.
Figure 3:
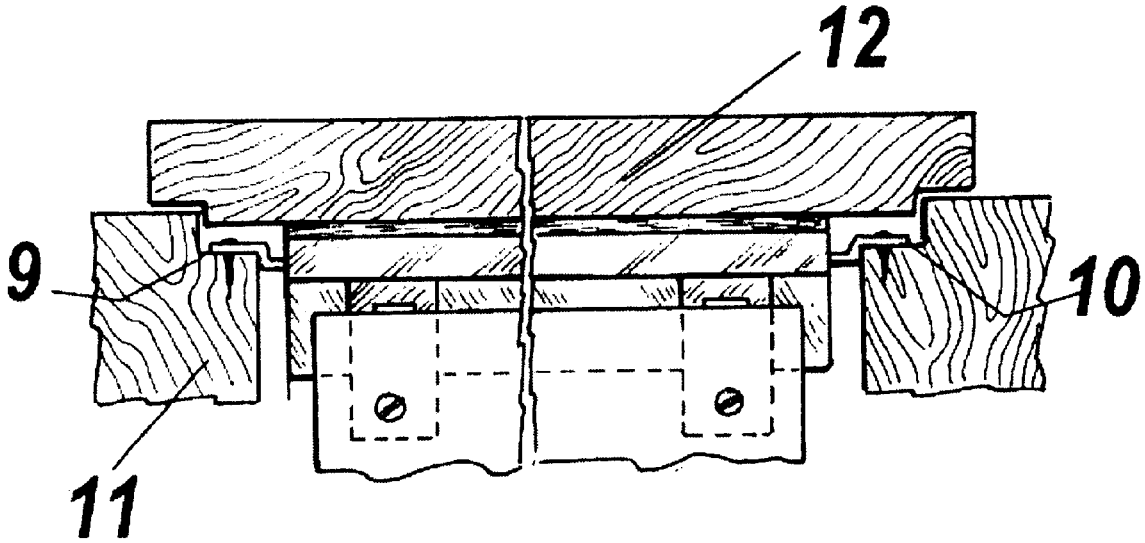
FIG. 3 is a shortened plan view of the doormat-fastening draught excluder, once it has been secured to the door frame and with the doormat fastened.

The invention consists in an improved draught excluder for fastening doormats, which is developed from those of the type in which the doormat is fixed directly to spikes projecting from the trapezoidal body forming the head of the draught excluder.

In the novel doormat-fastener, the fixing spikes on the head are omitted.

To that end, a rectangular sheet (1) is constructed with one of its longitudinal edges (2) bent at right-angles and terminating in the form of a "T" (3), with one of the arms (4) of the "T" extended in a downwardly inclined manner, while the opposite arm has an extension bent at right-angles (5), which is also directed downwards.

Respective elbowed extensions (7) of elbowed flat plates (8) are inserted in the longitudinal space (6) existing between the stem of the "T" (3) and its arm (5).

The plates (8) are fastened to rabbets (9 and 10) in the ends of the uprights (11) of the corresponding lintel of the door (12).

Rectangular sheets (13 and 14) extending perpendicularly to the "T"-shaped head (3) of the body fastening the doormat (15) have one of their ends (16) bent upwards in an arc and mounted within the longitudinal cavity (6) of the "T"-shaped head of the body of the fastener of the doormat (15).

Each perpendicular sheet (13 and 14) has an aperture (17 and 18) in its opposite end.

The doormat (15) is mounted on the perpendicular sheets (13 and 14) and is fastened thereto by means of metal cylindrical eyelets (19 and 20) which have an internal aperture having helically threaded walls and which extend through the apertures (21) in the support surface (22) of the doormat (15) and are made secure by corresponding screws (23 and 24) inserted through the respective apertures (17) and (18) in each sheet (13 and 14).

Thus, the doormat is joined to the corresponding perpendicular sheets and attached thereto by means of the eyelets which extend through the mat and secure it by means of the corresponding screws.

Near each end of the perpendicular sheet (13 and 14) are respective appendages (25 and 26) which are formed by rectangular partial punching in an upward direction so that the side wall of the doormat can bear against them.

What is claimed is:

1. An improved draught excluder, comprising:

an elongated body having a longitudinal edge;

a bent portion extending along said longitudinal edge and perpendicular to said elongated body;

said bent portion having a stem, a first transverse arm (4), and a second transverse arm (5), wherein said stem is disposed between said first transverse arm (4) and said second transverse arm (5) so that a longitudinal space (6) is created between said stem and said second arm (5), and a pair of plates (8) removably securing said improved draught excluder to a door rabbet.

2. An improved draught excluder according to claim 1, wherein said pair of plates (8) further includes an elbowed sheet (7), wherein said elbowed sheet (7) is slidably secured within said longitudinal space (6).

3. An improved draught excluder according to claim 2, further comprising:

a pair of rectangular sheets each having an upright portion (16) configured and dimensioned to be received within said longitudinal space.

4. An improved draught excluder according to claim 3, wherein each of said pair of rectangular sheets further includes a raised portion juxtaposed along an edge of a doormat.

5. An improved draught excluder according to claim 4, wherein each of said pair of rectangular sheets includes an aperture, a cylindrical eyelet having an internal helical thread, said cylindrical eyelet is received within said aperture, and a fastening screw is threaded within said internal helical thread for securing the improved draught excluder to said doormat.

* * * * *